United States Patent [19]

Menown et al.

[11] Patent Number: 4,890,034

[45] Date of Patent: Dec. 26, 1989

[54] THYRATRONS

[75] Inventors: Hugh Menown, Chelmsford; Robert E. Baker, Southminster; Leonard R. Cullum, Chelmsford, all of United Kingdom

[73] Assignee: English Electric Valve Company Limited, Chelmsford, England

[21] Appl. No.: 63,421

[22] Filed: Jun. 18, 1987

[30] Foreign Application Priority Data

Jun. 21, 1986 [GB] United Kingdom ..... 8615207

[51] Int. Cl.[4] ..... H01J 17/12

[52] U.S. Cl. ..... 313/595; 313/592; 313/609; 313/348; 313/293

[58] Field of Search ..... 313/592, 613, 616, 595, 313/599, 609, 348, 293; 315/326

[56] References Cited

U.S. PATENT DOCUMENTS 2,805,353 9/1957 Nienhuis ..... 313/592

FOREIGN PATENT DOCUMENTS 820885 9/1959 United Kingdom .
824762 12/1959 United Kingdom .
1138352 1/1969 United Kingdom .
2125613 3/1984 United Kingdom .

*Primary Examiner*—Robert L. Griffin
*Assistant Examiner*—T. Salindong
*Attorney, Agent, or Firm*—Spencer & Frank

[57] ABSTRACT

A thyratron includes a grid structure in which a grid element has a plurality of apertures therethrough, each of the apertures comprising two arcuate portions at different distances from the center of the grid which are connected by a radial portion. Thus a large grid area may be provided without detrimentally affecting voltage hold-off, jitter or mechanical soundness.

9 Claims, 2 Drawing Sheets

THYRATRONS

BACKGROUND OF THE INVENTION

This invention relates to thyratrons and more particularly to grids included in thyratrons.

Thyratrons are gas-filled devices in which a discharge occurs between an anode and cathode, typically through apertures in an intervening grid or grids. A grid may act as a control grid, in which its potential is controlled to influence the behaviour of the thyratron, or it may be passive or arranged to act as a baffle, for example. Grids are provided with one or more apertures therethrough to allow the discharge to pass between the cathode and the anode when the thyratron is conducting. It is desirable that the surface area presented by the apertures or aperture be as large as possible to permit a large discharge current to pass therethrough. However this may introduce structural problems and also reduce voltage hold-off capability. It is also desirable that the energy delivered to the grid by the discharge be dissipated without causing a substantial increase in grid temperature. Also where there are a large number of apertures used in a grid, the jitter times tend to be large.

SUMMARY OF THE INVENTION

The present invention seeks to provide a thyratron having a grid capable of passing large discharge currents with relatively low grid temperatures and small jitter values.

According to the present invention there is provided a thyratron including a grid having an aperture therein, the aperture comprising, at a surface of the grid, first and second acurate slots arranged at respective different distances from the centre of the grid which are connected by a substantially radial third slot. By employing the invention a grid can be provided which has a large conduction or slot, area, which may be approximately 50% of the total area of the surface of the grid in which it is located, without the voltage hold-off of the thyratron being impaired. A thyratron in accordance with the invention enables large rates of rise of current to be achieved, for example, of the order of $10^{12}$ amps/s The aperture volume may be large, in the region of 30% of the total volume of the grid. In a previous thyratron grid, a plurality of apertures is required therein to present a total slot area of comparable size to that available with a single aperture in a grid of a thyratron in accordance with the invention. Therefore a number of separate conducting paths exist through which the initial discharge may pass, resulting in large jitter times. In a thyratron in accordance with the invention, however, the first and second arcuate slots form part of a single aperture, and thus jitter times are reduced, as only one conduction path exists. Another advantage of a thyratron in accordance with the invention is that the grid may be constructed with a large slot area whilst being mechanically sound, so that warping or deformation does not occur, or is insignificant, when the grid is heated by a large discharge current passed therethrough, and having good thermal conduction properties.

Preferably, the aperture at one surface is offset, in a direction transverse to a straight line normal to the surfaces of an anode and cathode of the thyratron, from the aperture at another surface. This enables the voltage hold-off of the thyratron to be high whilst permitting large currents to be conducted. The offset may be such that there is some overlap between the aperture at one surface with that at the other but performance may be improved by ensuring that the offset is great enough to prevent a direct line of sight through the grid between the anode and cathode. The grid may be a "thick" grid, in which the path length through the aperture is at least five times greater than the smallest transverse dimension across the aperture, and it may be at least ten times greater than the smallest transverse dimensions. The transverse dimension of an aperture is that which is substantially normal to a straight line between an anode and cathode of the thyratron. Such a thick grid provides a large surface area on which recombination may take place, thus giving fast recovery times. By inclining the aperture, an offset may be achieved. In an alternative construction, the grid may comprise a plurality of grid elements at least one of which has an aperture therein which comprises non-intersecting first and second arcuate slots which are connected by a third substantially radial slot. Advantageously, one of the grid elements may be arranged to locate another and preferably one element has surfaces in two planes and the other element is arranged on a surface in one of the planes. This gives a particularly robust construction and facilitates the manufacture of a thick grid, which may be made in more than one part. Alternatively, the grid elements may be spaced apart from one another.

It may be advantageous to include a plurality of said apertures in the grid, and conveniently said plurality is three.

Advantageously, a second grid is arranged adjacent to the first-mentioned grid and has an aperture therethrough which is offset from that at the facing surface of the first mentioned grid in a direction transverse to a straight line normal to the surfaces of an anode and cathode the thyratron. Such an arrangement enables an improvement in voltage hold-off, obtained by off-setting the aperture in one grid from that in the other, to be achieved even where the first mentioned grid and the second grid consist only of a single "thin" element where it is not possible to achieve an offset in the grid itself.

BRIEF DESCRIPTION OF THE DRAWINGS

The invention is now further described by way of example with reference to the accompanying drawings in which.

DESCRIPTION OF A PREFERRED EMBODIMENT

Figure 1:
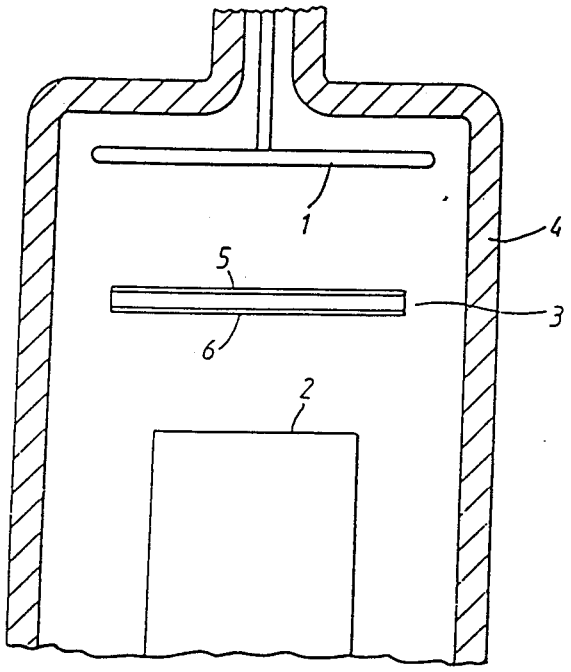
FIG. 1 schematically illustrates a thyratron in accordance with the invention.

With reference to FIG. 1, a thyratron includes an anode 1, a cathode 2 and an intermediate grid 3 contained within an envelope 4. The grid 3 is connected to act as a control grid which, in operation, is initially maintained at a negative bias potential to prevent conduction, and to which a trigger pulse is applied when conduction is required. The grid 3 consists of first and second grid elements 5 and 6.

Figure 2:
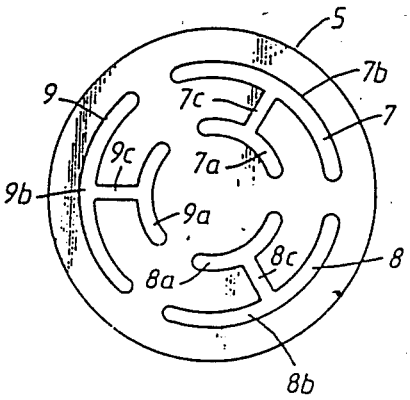
FIG. 2 is a plan view of one of the grid elements of the thyratron of FIG. 1.
Figure 3:
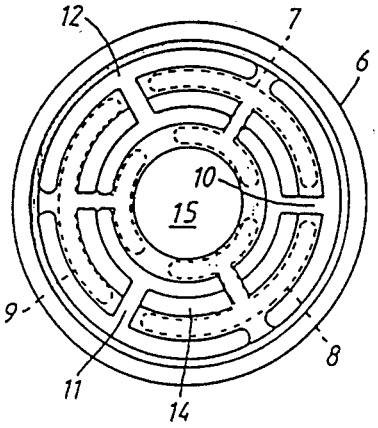
FIGS. 3 and 4 are plan and perspective views respectively of another grid element of the thyratron shown in FIG. 1.
Figure 4:
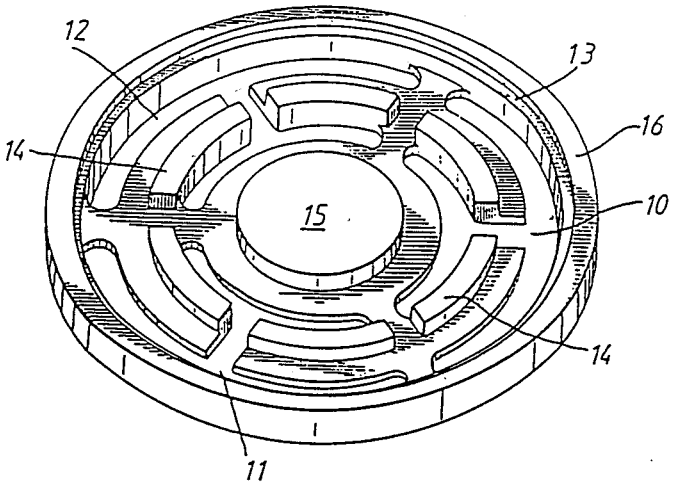
Figure 5:
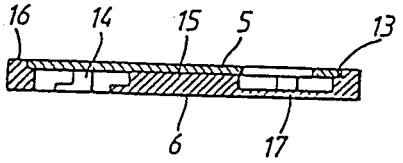
FIG. 5 is a tranverse section showing the grid elements illustrated in FIGS. 2, 3 and 4 arranged together.

The first grid element 5 located nearest the anode 1 is shown in greater detail in FIG. 2, and the second grid element 6 in FIGS. 3 and 4. The first grid element 5 is a copper disc having a thickness of about 2 mm and has three apertures 7, 8 and 9 therethrough. Each aperture consists of two arcuate slots or portions *7a*, *7b*, *8a*, *8b*, *9a* and *9b* which are respectively connected by radial slots or portions *7c*, *8c*, and *9c*. Thus the total aperture area of the grid element is of relatively large size and the grid element is also mechanically strong. The second grid element 6 also has three apertures, 10, 11 and 12 therethrough. These apertures 10, 11 and 12 are of similar shape to those through the first element 5, having two arcuate portions joined by a radial part. The second grid element 6 includes a ledge 13, ridge 14 and central portion 15 on which the first element 5 is positioned, the outer rim 16 of the second grid element 6 lying in the same plane as the surface of the first grid element 5 which faces the anode 1. The second grid element 6 includes a lower base portion 17 which is about 2 mm thick and is spaced about 3 mm from the first grid element 5. The apertures 10, 11 and 12 are located at a greater distance from the centre than the apertures 7, 8 and 9 of the first element 5. When the first and second elements 5 and 6 are arranged together therefore, as shown in FIG. 5, the apertures in one element are offset from those in the other. The dotted lines on FIG. 3 illustrate the location of the apertures 7, 8 and 9 in the first element 5 with respect to those in the second element 6 when the two grid elements are correctly positioned.

The grid 3 has good thermal conduction properties, heat being conducted, not only radially in one plane from the centre of the grid, but also along heat paths through the central portion to give radial conduction in other planes.

Although in the thyratron described only one grid is shown, there may of course be more than one included, for example, a primary grid may be included.

We claim:

1. A thyratron including a cathode, an anode, and a grid disposed between the cathode and the anode, said grid comprising a disk having an aperture therein and a center point; said aperture including: a first arcuate slot having as its center of curvature said center point of said disk, a second arcuate slot having as its center of curvature said center point of said disk, and a third slot disposed generally radially relative to said center point and connecting said first and second arcuate slots.

2. A thyratron as claimed in claim 1 wherein said aperture has a volume which is approximately 30% of the total volume of said disk.

3. A thyratron as claimed in claim 1 wherein said aperture has an area at a surface of said disk which is approximately 50% of the surface area of said disk.

4. A thyratron as claimed in claim 1 including a plurality of said apertures in said disk.

5. A thyratron as claimed in claim 4 wherein there are three said apertures.

6. A thyratron as claimed in claim 1 wherein said disk is relatively thick compared with the smallest width of said aperture, the thickness of said disk being at least five times greater than the smallest width of said aperture.

7. A thyratron including a cathode, an anode, and a grid disposed between the cathode and the anode, said grid comprising a body having a disk having a first aperture therein and a base portion arranged together with said disk; said first aperture having a first arcuate slot which is generally concentrically disposed about a first center point, a second arcuate slot which is generally concentrically disposed relative to the first center point, and a third slot disposed generally radially relative to the first center point and connecting said first and second arcuate slots; said base portion having a second aperture therein in communication with said first aperture, said second aperture having a first arcuate slot which is generally concentrically disposed about a second center point, a second arcuate slot which is generally concentrically disposed relative to the second center point, and a third slot disposed generally radially relative to the second center point and connecting said first and second arcuate slots; said first aperture and said second aperture being relatively disposed such that there is no direct line-of-sight between said anode and said cathode which passes through both said first and second apertures.

8. A thyratron as claimed in claim 7 wherein a path length through said aperture is at least five times greater than the smallest transverse dimension across said aperture.

9. A thyratron as claimed in claim 7 wherein said base portion has an annular rim extending toward and contacting said disk.

* * * * *